United States Patent [19]

Musso

[11] Patent Number: 4,747,708

[45] Date of Patent: May 31, 1988

[54] SELECTOR DEVICE FOR A CHARACTER-CARRYING ELEMENT ON PRINTING MACHINE

[75] Inventor: Pietro Musso, Ivrea, Italy

[73] Assignee: Ing. C. Olivetti & C., S.p.A., Ivrea, Italy

[21] Appl. No.: 866,254

[22] Filed: May 23, 1986

[30] Foreign Application Priority Data

May 29, 1985 [IT] Italy ..... 67491 A/85

[51] Int. Cl.[4] ..... B41J 1/06; B41J 1/26

[52] U.S. Cl. ..... 400/144.2; 400/154.4

[58] Field of Search ..... 400/144.1, 144.2, 144.3, 400/145.1, 145.2, 154.4, 155, 162.3, 163, 163.1, 142, 143, 175

[56] References Cited

U.S. PATENT DOCUMENTS

| | | | |
|---|---|---|---|
| 3,094,771 | 6/1963 | Robertson | 29/116 AD |
| 3,384,216 | 5/1968 | Thayer | 400/144.3 |
| 4,324,496 | 4/1982 | Link | 400/144.2 |
| 4,338,035 | 7/1982 | Kondo et al. | 400/144.2 |
| 4,444,519 | 4/1984 | Howell et al. | 400/144.2 X |
| 4,504,158 | 3/1985 | Ciampi et al. | 400/144.2 |
| 4,544,290 | 10/1985 | Schuiling et al. | 400/175 |
| 4,565,128 | 1/1986 | Moriyama et al. | 400/144.2 X |

FOREIGN PATENT DOCUMENTS

| | | | |
|---|---|---|---|
| 3312842 | 10/1984 | Fed. Rep. of Germany | 400/144.2 |
| 118868 | 9/1980 | Japan | 400/144.2 |
| 29690 | 2/1983 | Japan | 400/328 |

OTHER PUBLICATIONS

Design of Machine Elements 5th ed. Prentice Hall, Englewood Cliff, NJ 1978 by Spotts, pp. 433–434.

Product Engineering Oct. 26, 1959, pp. 71–75, "18 Ways to Control Backlash in Gearing" by Gutmann.

Machinery's Handbook 20th ed. Industrial Press, NY, NY 1978 by Oberg et al., p. 611.

*Primary Examiner*—Charles A. Pearson

*Attorney, Agent, or Firm*—Banner, Birch, McKie & Beckett

[57] ABSTRACT

The selector device for a character-carrying element of a printing machine comprises a d.c. electric motor whose rotor is capable of selectively rotating in both rotational directions a coupling arrangement comprising a pinion on the motor shaft and a gear on the shaft which carries the hub for mounting a daisywheel printing element and a strobe disc which provides the position signals used to control character selection. A device for taking up clearances minimizes the radial clearances between the pinion and the gear. Thus the motor is mounted on trunnions and urged by a spring to tilt in the sense urging the pinion into the gear.

7 Claims, 3 Drawing Sheets

SELECTOR DEVICE FOR A CHARACTER-CARRYING ELEMENT ON PRINTING MACHINE

BACKGROUND OF THE INVENTION

The present invention relates to a selector device for a character-carrying element of printing machines, in particular for typewriters, comprising a selector motor for rotating the charactercarrying element in two directions.

In one known selector device, the selector motor is coaxial with the strobe disc and with the character-carrying disc. That arrangement suffers from the disadvantage that it requires a selector motor which is accurate and capable of producing a high drive torque. The motor is therefore cumbersome and of rather substantial cost.

Also known are portable printing machines or typewriters which use a character-carrying element of the daisywheel type and in which the movement of the selector motor is transmitted to the daisywheel by means of a coupling arrangement as between a pinion and two toothed wheels which are disposed in side-by-side and coaxial relationship, of the type referred to as 'play-free'. The absence of play or clearance is achieved by the effect of a spring which is interposed between the two toothed wheels which are engaged with the teeth of the pinion. A coupling arrangement of that type is rather noisy and is not suitable for transmitting movement to the character-carrying element of the medium-spaced printing machines.

SUMMARY OF THE INVENTION

The object of the present invention is therefore to provide a selector device which is simple, compact and economical and which also permits quick and silent positioning of the character-carrying element.

The object is met by the selector device according to the invention, which comprises a pinion-gear coupling arrangement between the selector motor and the character-carrying element and a device for taking up the radial clearances of the pinion and the gear of the coupling arrangement.

BRIEF DESCRIPTION OF THE DRAWING

A preferred embodiment of the invention is set forth in the following description which is given by way of non-limiting example and with reference to the accompanying drawing in which.

DESCRIPTION OF THE PREFERRED EMBODIMENT

Figure 1:
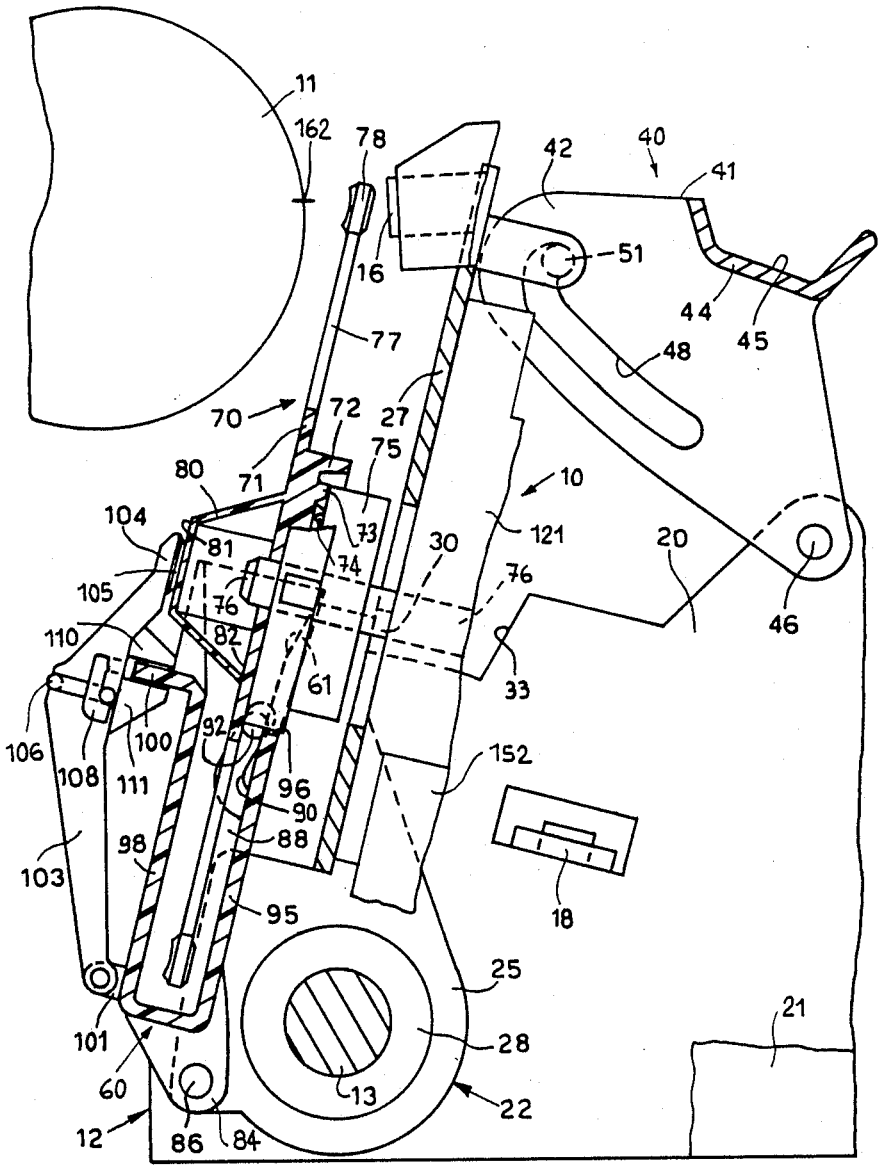
FIG. 1 shows a longitudinal view of part of a printing machine on which the selector device according to the invention is mounted.

Referring to FIG. 1, a selector device according to the invention is generally indicated by reference numeral 10 and is applied to a printing machine comprising a platen roller 11, a carriage 12 which is movable on a cylindrical guide 13 parallel to the platen roller 11, and a print hammer or striker 16. The carriage 12 comprises two side members 20 and 21 which are parallel to each other and orthogonal to the axis of the guide 13. The translatory movement of the carriage 12 in front of the platen roller 11 is controlled by a motor (not shown in the drawing), by means of a belt 18 which is connected to the side members 20 and 21 of the carriage.

A frame 22 which is disposed between the side members 20 and 21 of the carriage 12 is of such a configuration as to provide two side members 25 and a plate 27 wihch is parallel to the platen roller 11 and on which the printing hammer 16 and the selector device 10 are mounted. The side members 25 of the frame 22 are fixed to two bushes 28 mounted coaxially with the cylindrical guide 13 within the side members 20 and 21 of the carriage 12. In that way the frame 22 is pivoted with respect to the guide 13 and follows the movements of the carriage 12 in front of the platen roller 11. Only one bush 28 and one side member 25 can be seen in the drawing.

The plate 27 of the frame 22 is provided with two side limbs 30 (only one can be seen in the drawing) which each co-operate with a shoulder 33 provided on each side member 20 and 21 of the carriage 12. The shoulders 33, by co-operating with the limbs 30, limit to about 16° the rotary movement that the frame 22 can perform with respect to the cylindrical guide 13.

A mechanism 40 comprises a manually actuable bridge lever 41 and is capable of controlling the inclination of the frame 22. In particular the lever 41 comprises two side arms 42 (only one can be seen in the drawing) which are parallel to the side members 20 and 21 and a transverse portion 44 which is of such a configuration as to define a recess 45 in which the operator can press with the fingers of the hand to move the lever 41 towards the platen roller 11 or to pull it away therefrom. The two arms 42 of the lever 41 are each pivoted on a pin 46 fixed to the side member 20, 21 of the carriage 12 and each arm 42 has a slot 48 with which a peg 51 on the frame 22 co-operates. Each slot 48 is of such a configuration that a clockwise rotary movement of the lever 41 produces a similar clockwise rotary movement of the frame 22.

A tray 60 of plastics material is disposed substantially vertically between the frame 22 and the platen roller 11. The tray 60 is of a substantially parallelepipedic shape and has a top opening 61 through which a character-carrying 'daisywheel' disc 70 of known type can be fitted, being for example of the type described in published European patent application No. EP 0 118 277.

In particular, the disc comprises a central hub 71 and a plurality of radial flexible spokes 77 at the end of each of which is disposed a raised print character 78. Provided in a cylindrical portion 72 of the hub 71 are coupling means 73 which are capable of coupling with corresponding coupling means 74 provided on the front of a flange 75 which is fixed on a shaft 76 of the selector device 10. A handle or gripping means 80 having a front wall portion 81 is fixed on a front surface 82 of the central hub 71.

The tray 60 is provided at its bottom at the sides thereof with two projections 84, only one of which can be seen in the drawing. The projections 84 are each pivoted on a pin 86 on the frame 22. Also provided in the two side portions 88 of the tray 60 are two slots 90 (only one of which can be seen in the drawing), with which two pins 92 (only one can be seen in the drawing) on the carriage 12 co-operate. The slots 90 are of such a configuration that, corresponding to a clockwise rotary movement of the frame 22 is a substantially vertical lift movement of the tray 60, combined with a slight rotary movement in the clockwise direction of the tray 60. The tray 60 is further provided on a rear wall portion 95 thereof with a semicyclindrical recess 96 against which the character-carrying disc 70 can bear by means of the cylindrical portion 72 thereof during the insertion phase. A lever 103 is pivoted on a lower lug 101 on the tray 60 and at its upper end 104 carries an element 105 capable of co-operating with the wall portion 81 of the gripping means 80 of the charactercarrying disc 70.

The lever 103 is urged constantly towards a wall portion 98 of the tray 60 by a spring 106 formed by a steel rod whose ends are hooked on to two vertical lugs 108, only one of which is visible but which are disposed at the sides of the horizontal rib 100. The lever 103 is provided with two guide lugs 110 and 111 which co-operate with the rib 100 on the front wall portion 98 of the tray 60.

The mode of operation of the above-described arrangement is substantially the same as that described in U.S. Pat. No. 4,553,868 assigned to Ing. C. Olivetti & C., S.p.A.

and which therefore has been partially described and illustrated in the drawing in order more clearly to set forth the aims of the selector device 10 according to the invention.

Figure 2:
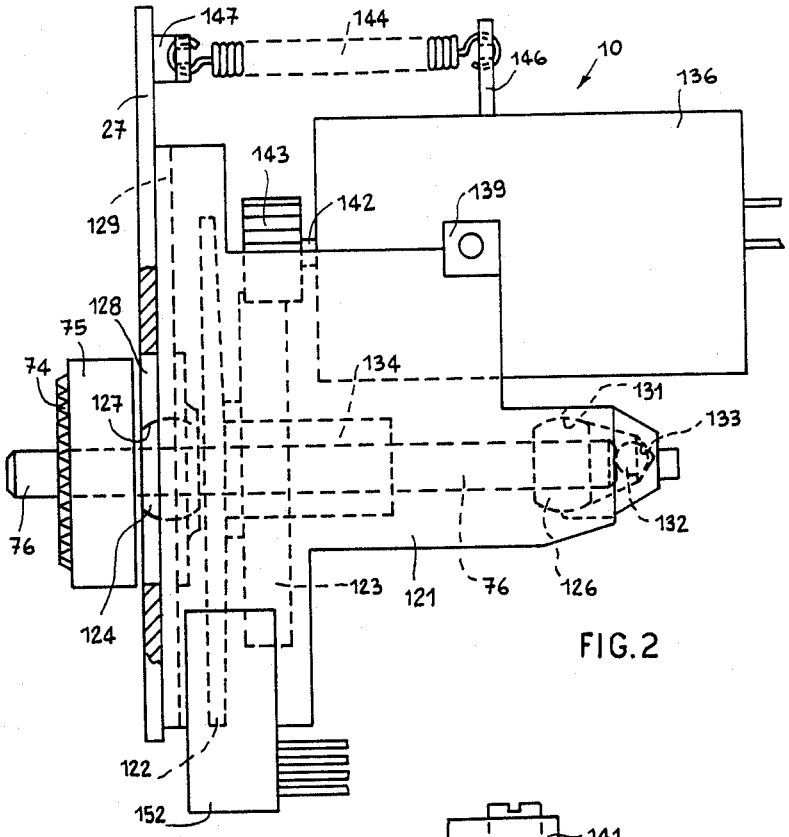
FIG. 2 is a longitudinal view of part of the device shown in FIG. 1.

The selector device 10 (see FIG. 2) comprises a casing 121 housing the shaft 76, a stroke or synchronisation disc 122 and a gear 123. The casing 121 is fixed to the plate 27 in known manner, for example by means of screws which are not shown in the drawing.

The shaft 76 is rotatable on two spherical bushes 124 and 126, one of which is mounted in a seat or opening 127 in a sleeve member 128 of a cover 129 of the casing 121 while the second is mounted in a seat or opening 131 of the casing 121.

The end of the shaft 76 which projects from the bush 126 at the opposite end with respect to the region in which it is fixed to the flange 75 normally bears against a ball 132 received in a conical seat 133 in the casing 121. The ball 132 is to perform a thrust bearing function to compensate for the force of the spring 106 (see FIG. 1) which, by means of the lever 103 and the element 105, presses against the flange 75 fixed to the end of the shaft 76 when the arrangement is assembled as shown in FIG. 1.

The gear 123 (see FIG. 2) is mounted fixedly on a sleeve 134 on the strobe disc 122, which in turn is fixed on the shaft 76. Therefore the shaft 76 is fixed in respect of rotary movement to the flange 75, the strobe disc 122 and the gear 123.

Figure 3:
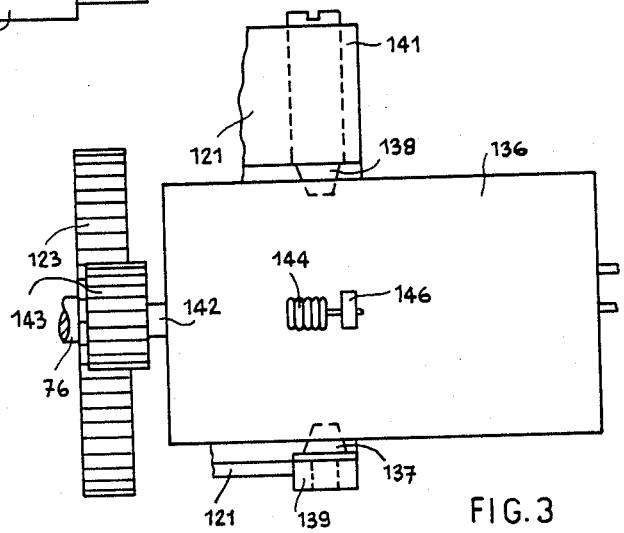
FIG. 3 is a view of part of the device of FIG. 2.

A d.c. selector motor 136 has a rotor with a shaft 142 on which is fixed a pinion 143 which is arranged to be engaged with the teeth of the gear 123, and a stator which is mounted in such a way that it can swing on the casing 121 by means of two pins 137 (see FIG. 3) and 138. The pin 137 is fixed on a support 139 of the casing 121 while the pin 138 is adjustable and rotatable on a support 141 of the casing 121 for adjusting the position of the motor 136 on the casing 121, the motor 136 being rotatable about the pins 137 and 138.

A spring 144 which is fitted between a lug 146 on the motor 136 and a lug 147 (see FIG. 2) on the plate 27 causes the motor 136 to tilt in the anticlockwise direction and therefore holds the pinion 143 always in engagement and in mesh with the gear 123, without radial clearances or play between the two gears.

The teeth of the gear 123 and the pinion 143 have been designed with a particular arrangement such as to permit the clearances or play between the teeth of the two gears always to be taken up by virtue of the action of the spring 144, even in the event of wear on the teeth themselves.

Figure 7:
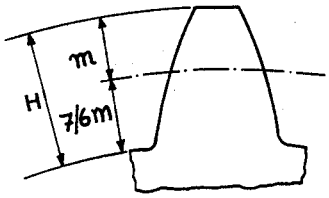
FIG. 7 shows an element for comparison in respect of the detail shown in FIG. 6.

As is known, in standardised tooth configurations (see FIG. 7), a tooth of a height H comprises an addendum, that is to say the part which is between the pitch circle and the tip of the tooth, which is equal to m, and a dedendum, that is to say the part between the base of the tooth and the pitch circle, which is equal to 7/6 m. The complete height is thus: $H=m+7/6m$, that is to say the sum of the modulus plus seven sixths of the modulus, wherein the modulus 'm' denotes the ratio between the pitch circle diameter represented by the dash-dotted line in FIG. 7, and the number z of teeth of the gear, that is to say: $m=dp/z$.

Figure 6:
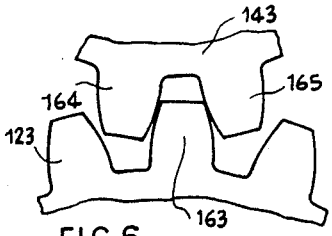
FIG. 6 shows a detail on an enlarged scale of the device shown in FIG. 2.

In the case of the teeth on the pinion 143 (see FIG. 6) and the gear 123, the addendum according to the invention is in this case a fraction of the modulus and is always smaller by about 1/10 than the value of the modulus, while the dedendum retains its value which is equal to seven sixths of the modulus. Therefore the value of H is reduced by at least 1/10 m with respect to the standardised value. In addition, between the tip of a tooth 163 and the base between two opposite teeth 164 and 165 there is always a gap which is greater than that prescribed in meshing between standardised teeth. That ensures that the teeth of the two gears 123 and 143 will always operate with the side of the teeth and there will no longer be engagement between the tip of the tooth and the base of the tooth, even with a substantial degree of water. The foregoing can be clearly seen from FIG. 6 in which, with the addendum reduced in both of the gears, there is a clearly visible gap between the tip and the base of the meshing teeth.

Figure 4:
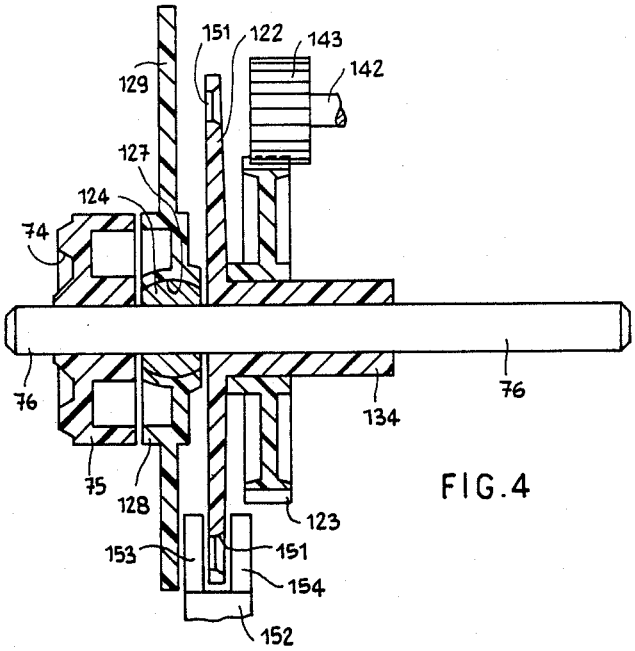
FIG. 4 shows a partly sectional longitudinal view of the FIG. 2 structure.

The strobe disc 122 (see FIG. 4) has a series of holes or slots 151 which are disposed adjacent to the circumference and co-operates with an optical transducer 152 comprising a lighting means 153 and a photodetector 154 which are disposed on opposite sides with respect to the path of movement of the slots 151. during the rotary movement of the shaft 76 and thus the strobe disc 122, the optical transducer 152 signals the clockwise and anticlockwise rotary movements of the strobe disc 122 to an input-output unit 156.

Figure 5:
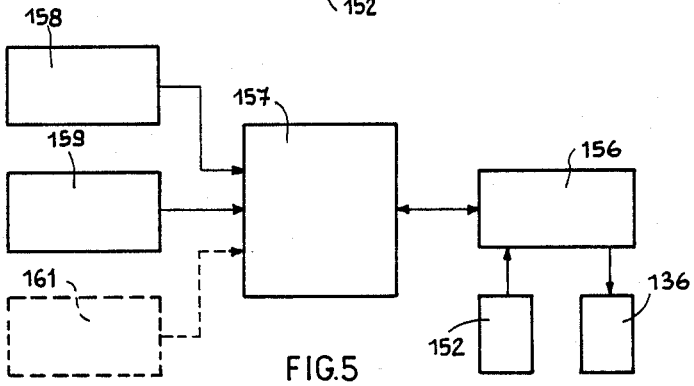
FIG. 5 is a logic block diagram of a control unit for controlling the machine shown in FIG. 1.

The input-output unit 156 (see FIG. 5) is connected to a central unit 157 which can receive information and data from keyboards 158, from various memories 159 comprising for example ROM and RAM, and from processors 161. The central unit 157 processes the data and by means of the information from the optical transducer 152 controls clockwise or anticlockwise rotary movements of the d.c. motor 136 which, by rotating in a clockwise or anticlockwise direction, positions the selected character 78 (see FIG. 1) in front of the point of printing 162 on the platen roller 11.

It will be apparent that, in the selector device 10 for the character-carrying element 70 according to the invention, the spring 144 is operable to cause the motor unit 136 together with the pinion 143 to rotate, to take up and thus eliminate radial play or clearance between the pinion 143 and the gear 123. That structure makes it possible to achieve positioning with a high degree of accuracy and in a repetitive manner of the characters 78 in front of the point of printing 162, even at high speed and after a long period of use. The transmission ratio as between the pinion 143 and the gear 123 is 23/80, thus permitting the use of a d.c. motor 136 of reduced power and thus of small dimensions and weight, with the movement being transmitted in a very silent fashion, even at high speed.

In addition, the reduced size and weight of the motor 136 facilitate balanced rotation of the frame 22, as described in the above-mentioned U.S. Pat. No. 4,553,868.

What I claim is:

1. A selector device for a rotary character-carrying element of a printing machine, comprising spring means; a selector motor for rotating the character-carrying element in both rotational directions; a pinion-gear coupling arrangement disposed between the selector motor and the character-carrying element comprising a pinion and a gear; a fixed support having two spherical bushes and a thrust bearing ball rotatable in the fixed support; a shaft rotatably supported by said two spherical bushes in the fixed support and comprising a flange; wherein the character-carrying element is urged by said spring means against said flange and wherein said shaft cooperates with the thrust bearing ball to absorb the axial thrust of said spring means; wherein said gear is mounted fixedly and coaxially on said shaft which is fixed in respect of rotary movement to said flange and said gear; wherein said fixed support further comprises two pins and said selector motor and a motor shaft on which is fixed said pinion; wherein said selector motor can swing on the fixed support by means of said two pins; wherein the pinion and the gear have teeth which have a reduced addendum with respect to the standard value of the modulus of the teeth and further providing a device for taking up the radial play between the pinion and the gear; wherein said device for taking up the radial play causes the selector motor to tilt in an engagement direction, wherein said device holds the pinion always in engagement and in mesh with the gear, without radial play between the teeth of the pinion and the gear even in the event of wear on the teeth themselves.

2. A selector device according to claim 1, wherein the fixed support comprises a first seat and a second seat, wherein one pin is fixed on the first seat while the other pin is adjustable and rotatable on the second seat for adjusting the position of the selector motor.

3. A selector device according to claim 1, wherein said device for taking up the radial play comprises a spring fitted between the selector motor and the fixed support for tilting the selector motor in said engagement direction, wherein the device holds the pinion in engagement and in mesh with the gear.

4. A selector device according to claim 1, further comprising a position transducer having a synchronization disc, wherein the synchronization disc and the gear and fixed on said shaft between the spherical bushes, and wherein the character-carrying element is of daisy-wheel type and is coaxial with the gear and with the synchronization disc.

5. The selector device according to claim 4, wherein the synchronization disc has a series of holes which are disposed adjacent to the circumference and cooperate with the position transducer, wherein the position transducer is of optical type and has a lighting means and a photodetector which are disposed on opposite sides with resepct to the path of movement of the holes, and wherein the position transducer signals the clockwise and counterclockwise rotary movements of the synchronization disc and the predetermined positions reached by the character-carrying element.

6. A selector device for a rotary character-carrying element of a printing machine comprising a selector motor for rotating the character-carrying element in both rotational directions; a pinion-gear coupling arrangement disposed between the selector motor and the character-carrying element comprising a pinion and a gear; a frame having a lug; a support rigidly fixed on the frame and having two spherical bushes and two pins; a shaft which is rotatable by means of said two spherical bushes in the support; wherein said shaft supports said gear fixedly and coaxially and drives the character-carrying element; wherein the selector motor has a lug on its stator and a rotatable motor shaft on its rotor and on which is fixed said pinion, and wherein said selector motor can swing on the support by means of the two pins; wherein the pinion and the gear have teeth which have a reduced addendum with respect to the standard value of the modulus of the teeth; and wherein a device for taking up the radial play between the pinion and the gear comprises a spring fitted between the lug of the selector motor and the lug of the frame, and wherein said spring causes the selector motor to tilt in a direction wherein the spring holds the pinion always in engagement and in mesh with the gear without radial play between the teeth of the pinion and the gear even in the event of wear on said teeth.

7. A selector device for a rotary character-carrier of a printing machine comprising a selector motor having a casing and a rotatable motor shaft, an intermediate shaft having a first end portion for removably fixing said character-carrier, a pinion-gear coupling between the motor shaft and said intermediate shaft, a plate frame and mounting means for mounting said motor shaft and said intermediate shaft on said plate frame and taking up the play of said pinion-gear coupling arrangement, said mounting means comprising:

support means for being fixed to said plate and supporting a first and a second bush for rotatably supporting said intermediate shaft, wherein the first bush is adjacent to said frame plate and said first end portion and the second bush is far away from said frame plate, and wherein the first and second bushes define the axis of rotation of said character-carrier;

pivoting means for pivotally mounting the casing of said motor on said support means about a pivoting axis which is perpendicular to a plane including the axis of rotation of the character-carrier and the axis of said motor shaft, wherein the pinion-gear coupling arrangement comprises a pinion fixed on said motor shaft and a gear wheel fixed on said intermediate shaft, and wherein said casing may pivot between a first position wherein the pinion is in engagement with said gear wheel and a second position wherein the pinion is away from said gear wheel; and spring means for biasing said casing toward said first position, and wherein said pinion and said gear wheel have a reduced addendum in order to cause a meshing of said pinion with said gear wheel without substantial radial play even in the event of wear on said teeth, wherein each one of said first and second bushes comprises a spherical outer portion, and wherein said support means comprises a first and a second spherical seat to be engaged by the spherical outer portion of said first and second bushes, respectively.

* * * * *